US008270867B2

(12) United States Patent
Shimizu

(10) Patent No.: US 8,270,867 B2
(45) **Date of Patent: *Sep. 18, 2012**

(54) IMAGE FORMING APPARATUS AND PROCESS CARTRIDGE

(75) Inventor: Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/333,508

(22) Filed: Dec. 21, 2011

(65) Prior Publication Data

US 2012/0093540 A1 Apr. 19, 2012

Related U.S. Application Data

(63) Continuation of application No. 12/412,077, filed on Mar. 26, 2009, now Pat. No. 8,175,489.

(30) Foreign Application Priority Data

May 30, 2008 (JP) ..... 2008-142104

(51) Int. Cl.
*G03G 21/20* (2006.01)
*G03G 15/01* (2006.01)

(52) U.S. Cl. ..... 399/92; 399/112

(58) Field of Classification Search ..... 399/92, 399/94, 111, 112

See application file for complete search history.

(56) References Cited

U.S. PATENT DOCUMENTS 7,426,355 B2 9/2008 Okabe
7,809,303 B2 10/2010 Igarashi
7,877,037 B2 1/2011 Igarashi
2007/0036577 A1 2/2007 Okabe et al.
2007/0071484 A1 3/2007 Igarashi
2007/0110468 A1 5/2007 Shimazu et al.
2007/0146739 A1 6/2007 Igarashi
2008/0101816 A1 5/2008 Nogami
2011/0097101 A1 4/2011 Igarashi

FOREIGN PATENT DOCUMENTS

JP 05-323755 A 12/1993
JP 09-190134 A 7/1997
JP 09-204090 A 8/1997

(Continued)

OTHER PUBLICATIONS

JP Decision of Grant Apr. 26, 2011, JP Appln. 2008-142104, English Translation.

(Continued)

*Primary Examiner* — Sophia S Chen
(74) *Attorney, Agent, or Firm* — Banner & Witcoff, Ltd.

(57) ABSTRACT

An image forming apparatus has plural process cartridges. Each process cartridge includes a photosensitive element; an electrification unit including a discharging unit and an electrification frame which contains the discharging unit and which has a first opening formed between the photosensitive element and the discharging unit and a second opening formed at a position opposite the first opening across the discharging unit; and a process frame including an exposure opening opposing the photosensitive element. The process cartridges are arranged such that one process cartridge of a pair of adjacent process cartridges opposes the second opening and the exposure aperture of the electrification unit of the other process cartridge. Also a regulation member configured to regulate airflow is provided between the pair of process cartridges. The regulation member has elasticity and is disposed in a position between the second opening and the exposure aperture of the electrification unit.

7 Claims, 7 Drawing Sheets

FOREIGN PATENT DOCUMENTS

| | | | |
|---|---|---|---|
| JP | 2003-084632 | A | 3/2003 |
| JP | 2003-131461 | A | 5/2003 |
| JP | 2006-091327 | A | 4/2006 |
| JP | 2006-268064 | A | 10/2006 |
| JP | 2007-072420 | A | 3/2007 |
| JP | 2007-072421 | A | 3/2007 |
| JP | 2007-086539 | A | 4/2007 |
| JP | 2007-086629 | A | 4/2007 |
| JP | 2007-178608 | A | 7/2007 |
| JP | 2007-298782 | A | 11/2007 |

OTHER PUBLICATIONS

JP Office Action Aug. 24, 2010, JP Appln. 2008-142104, English Translation.

IMAGE FORMING APPARATUS AND PROCESS CARTRIDGE

CROSS REFERENCE TO RELATED APPLICATION

The present application is a continuation of U.S. application Ser. No. 12/412,077 dated Mar. 26, 2009 and claims priority from Japanese Patent Application No. 2008-142104, which was filed on May 30, 2008, the disclosures of these applications are herein incorporated by reference in its entirety.

TECHNICAL FIELD

Apparatuses and devices consistent with the present invention relate to an image forming apparatus having a plurality of process cartridges, each of which has a photosensitive drum, an electrification unit, and an exposure aperture.

BACKGROUND

Japanese unexamined patent application publication No. JP-A-2007-72421 describes a related art image forming apparatus. The related art image forming apparatus radiates a laser beam on an electrified photosensitive drum, to thus reduce an electric potential of an area irradiated with the laser beam and generate an electrostatic latent image on the photosensitive drum; supplies the electrostatic latent image with a developing agent; and transfers to a sheet a developing-agent image that is generated as a result of a developing agent being supplied to the electrostatic latent image, thereby generating an image on the sheet.

The related art image forming apparatus has a plurality of photosensitive drums, a plurality of corona discharge electrification units that electrify the respective photosensitive drums; and a plurality of process cartridges each having a process frame that supports a corresponding photosensitive drum and a corresponding electrification unit and that has an exposure aperture for exposing the corresponding photosensitive drum. Specifically, in this apparatus, the respective process cartridges are arranged in one direction in such a way that one of a pair of adjacent process cartridges opposes an electrification unit of the other process cartridge. The electrification unit has a discharging unit which extends along a surface of the photosensitive element and which is configured to electrify the photosensitive element by discharging and an electrification frame that supports the discharging unit and that has an aperture for orienting the discharging unit toward the photosensitive drum and the outside.

SUMMARY

Related art image forming apparatuses have a few disadvantages. For example, according to the image forming apparatus, ions develop in an electrification wire when a voltage is applied to the electrification wire of the electrification unit, and the ions migrate toward the photosensitive drum. At this time, an airflow (hereinafter also called "ionic wind") resultant from migration of ions flows into a process frame by passing through the aperture of the electrification frame; and subsequently flows through the exposure aperture of the process frame while capturing airborne paper dust or toner, to thus exit to the outside of the process frame. However, when ionic wind exited to the outside of the process frame after having passed through the exposure aperture collides with an adjacent process cartridge, to thus again flow into the process frame from the aperture of the electrification frame, paper dust or toner included in the ionic wind adheres to the electrification wire, whereupon electrification performance of the electrification unit and image quality are deteriorated. Further, when the ionic wind re-entered to the process frame as mentioned above collides with the photosensitive drum, the photosensitive drum is deteriorated by ozone included in the ionic wind and stained with the toner or paper dust included in the ionic wind, so that image quality is degraded.

Exemplary embodiments of the present invention address the above disadvantages and other disadvantages not described above. However, the present invention is not required to overcome the disadvantages described above, and thus, an exemplary embodiment of the present invention may not overcome the problems described above.

Accordingly, it is an aspect of the present invention to provide an image forming apparatus and a process cartridge that enable enhancement of image quality by regulating flow of ionic wind.

According to an exemplary embodiment of the present invention, there is provided an image forming apparatus including a plurality of process cartridges, each of which has a photosensitive element that undergoes generation of an electrostatic latent image, an electrification unit that has a discharging unit which extends along a surface of the photosensitive element and which is configured to electrify the photosensitive element by discharging and an electrification frame that contains the discharging unit and that has a first opening formed between the photosensitive element and the discharging unit and a second opening formed at a position opposite the first opening with the discharging unit interposed therebetween, and a process frame that supports a corresponding photosensitive element and a corresponding electrification unit and that has an exposure opening opposing the photosensitive element for exposing the photosensitive element, wherein the plurality of process cartridges are arranged in such a manner that one process cartridge of a pair of adjacent process cartridges opposes a second opening and an exposure aperture of the electrification unit of a remaining process cartridge; a regulation member for regulating airflow is provided between the pair of process cartridges; and the regulation member exhibits elasticity and is interposed between the opening of the electrification unit and the exposure aperture.

Further, according to the exemplary embodiment, there is provided a process cartridge of the present invention is a process cartridge comprising: a photosensitive element that undergoes generation of an electrostatic latent image; an electrification unit that has a discharging unit which extends along a surface of the photosensitive element and which is configured to electrify the photosensitive element by discharging and an electrification frame that contains the discharging unit and that has a first opening formed between the photosensitive element and the discharging unit and a second opening formed at a position opposite the first opening with the discharging unit interposed therebetween; and a process frame that supports a corresponding photosensitive element and a corresponding electrification unit and that has an exposure opening opposing the photosensitive element for exposing the photosensitive element, wherein an elastically-deformable regulation member that projects to an outside is provided on a surface of the electrification unit located between the second opening and the exposure aperture.

Further, according to the exemplary embodiment, there is provided a process cartridge of the present invention is a process cartridge comprising: a photosensitive element that undergo generation of an electrostatic latent image; an electrification unit that has a discharging unit which extends along a surface of the photosensitive element and which is configured to electrify the photosensitive element by discharging and an electrification frame that contains the discharging unit and that has a first opening formed between the photosensitive element and the discharging unit and a second opening formed at a position opposite the first opening with the discharging unit interposed therebetween; and a process frame that supports a corresponding photosensitive element and a corresponding electrification unit and that has an exposure opening opposing the photosensitive element for exposing the photosensitive element, wherein an elastically-deformable regulation member projecting to an outside is provided on a surface of the process cartridge opposing a surface of the electrification unit of an adjacent process cartridge between a second opening and an exposure aperture when the process cartridge is attached to an image forming apparatus.

In the image forming apparatus and the process cartridge of the present invention, ionic wind developed in the discharging unit passes through the exposure aperture to exit to the outside of the process frame after being blown to the photosensitive element. At this time, even when the ionic wind attempts to migrate toward the electrification unit as a result of colliding with an adjacent process cartridge, migration is regulated by the regulation member. Hence, reentry of the ionic wind exited from the exposure aperture into the second opening of the electrification unit is inhibited. Thus, since reentry of the ionic wind into the process frame is regulated, adhesion of extraneous matters included in the ionic wind, such as paper dust and a developing agent, to the discharging unit and the photosensitive element or deterioration of the photosensitive element, which would otherwise be caused by ozone included in the ionic wind, can be prevented. Therefore, image quality can be enhanced.

According to the exemplary embodiment of the present invention, since the regulation member can inhibit reentry of the ionic wind exited from the exposure aperture into the second opening of the electrification unit, staining of the photosensitive element and the discharging unit, which would otherwise be caused by extraneous matters, or deterioration of the photosensitive element, which would otherwise be caused by ozone, can be prevented. Thus, image quality can be enhanced.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

<Entire Configuration of a Color Printer>

Figure 1:
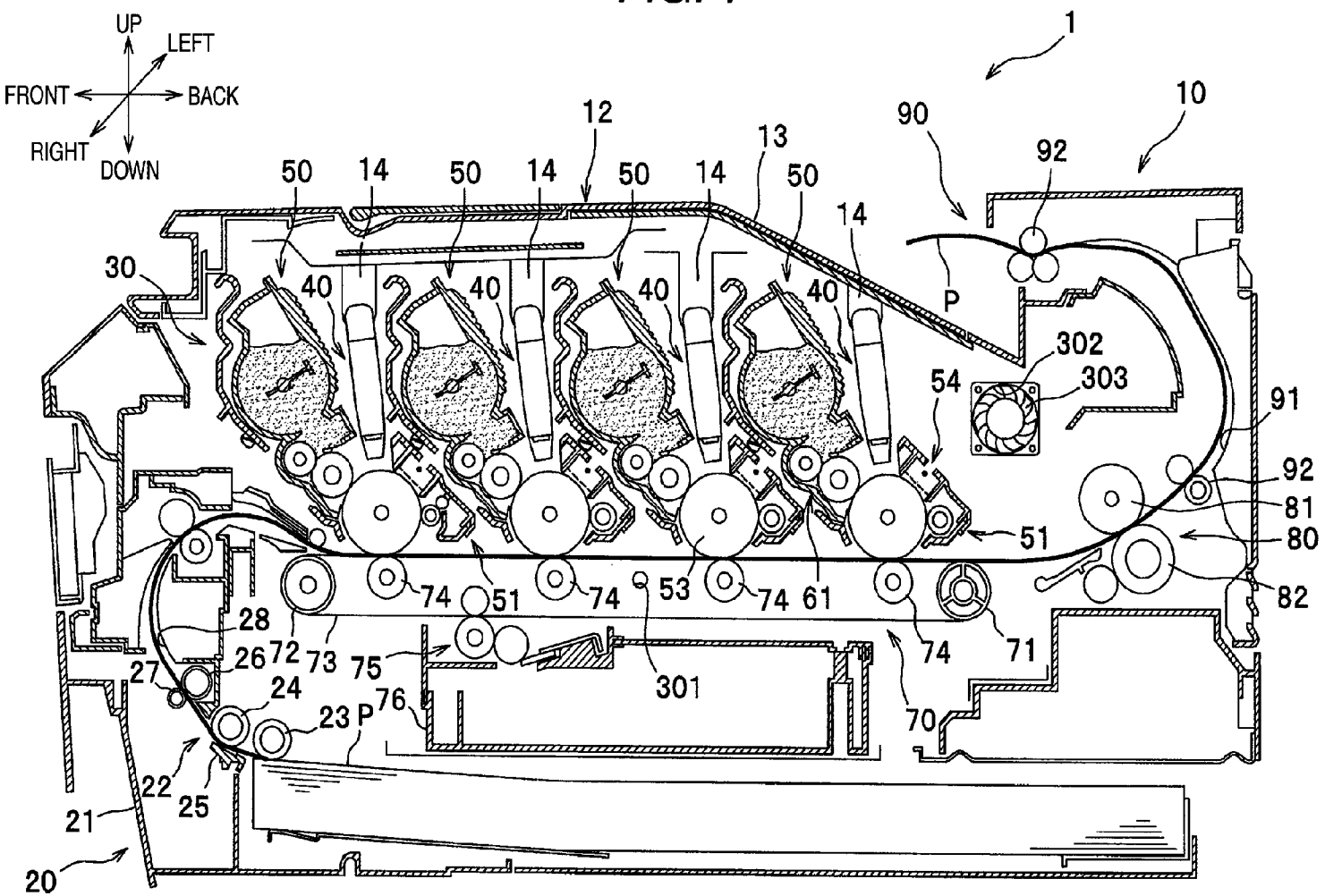
FIG. 1 is a cross-sectional view showing the overall configuration of a color printer serving as an example of an image forming apparatus.

An exemplary embodiment of the present invention will now be described in detail by reference to the drawings, as needed. Among the drawings to which reference is to be made, FIG. 1 is a cross-sectional view showing the overall configuration of a color printer serving as an example of an image forming apparatus, and FIG. 2 is an enlarged cross-sectional view showing the structure of a process cartridge.

In the following descriptions, directions are explained in accordance with orientations achieved when a user uses a color printer. In FIG. 1, a left side achieved when a reader faces a drawing sheet is taken as a "front side" (a proximal side); a right side achieved when the reader faces the drawing sheet is taken as a "rear side" (a distal side); a distal side achieved when the reader faces the drawing sheet is taken as a "left side"; and a proximal side achieved when the reader faces the drawing sheet is taken as a "right side." Moreover, up and down directions achieved when the reader faces the drawing sheet are taken as a "vertical direction."

Figure 2:
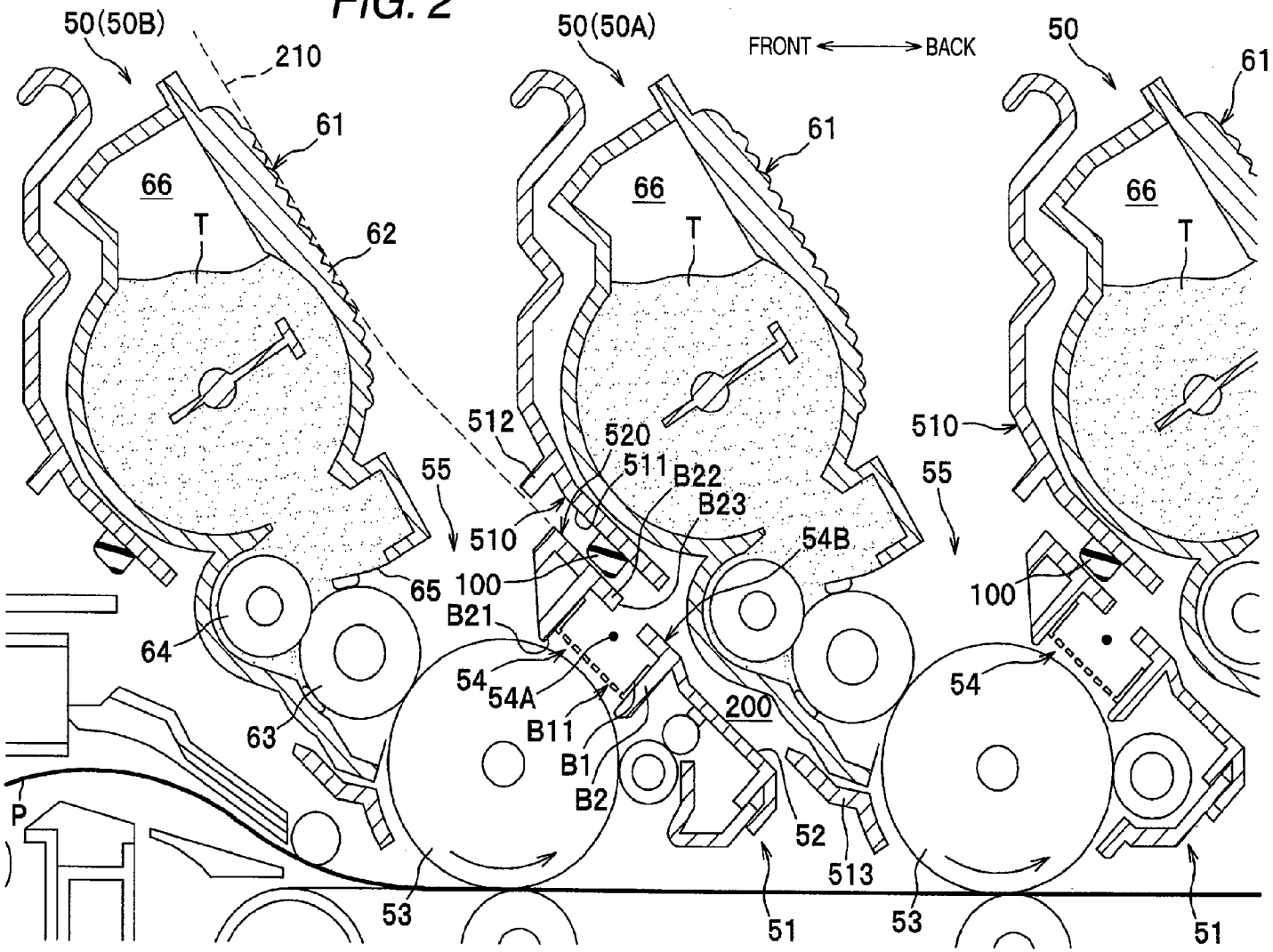
FIG. 2 is an enlarged cross-sectional view showing the structure of a process cartridge.

As shown in FIG. 1, the color printer 1 has, within an apparatus main unit 10 (a main body frame), a sheet feed unit 20 for feeding a sheet P; an image forming unit 30 for forming an image on the fed sheet P; and a sheet output unit 90 that outputs the sheet P with the image formed thereon.

An openable and closable upper cover 12 is provided in an upper portion of the apparatus main unit 10 so as to be vertically rotatable while taking a hinge provided at the rear of the upper cover as a fulcrum. An upper surface of the upper cover 12 makes up a sheet output tray 13 where the sheets P output from the apparatus main unit 10 are piled up. A plurality of hold members 14 for holding LED units 40 serving as an example exposure member are provided on a lower surface of the upper cover 12.

The sheet feed unit 20 has a sheet feed tray 21 that is disposed at a lower area within the apparatus main unit 10 and that is removably attached to the apparatus main unit 10; and a sheet feed mechanism 22 that conveys the sheet P from the sheet feed tray 21 to the image forming unit 30. The sheet feed mechanism 22 is provided at a proximal position with respect to the sheet feed tray 21 and has a sheet feed roller 23, a separation roller 24, and a separation pad 25.

In the thus-configured sheet feed unit 20, the sheets P in the sheet feed tray 21 are separated one at a time and sent upwardly. In the course of passing through a path between a paper dust removal roller 26 and a pinch roller 27, the sheet undergoes removal of paper dust, and the sheet subsequently passes through a conveyance path 28, to thus be turned around and fed to the image forming unit 30.

The image forming unit 30 has four LED units 40; four process cartridges 50; a transfer unit 70; and a fixing unit 80.

Each of the LED units 40 has a plurality of LEDs arranged in line along a right-left direction. As a result of the plurality of LEDs blinking in accordance with data, the LED unit 40 exposes a corresponding photosensitive drum 53, thereby producing an electrostatic latent image of a predetermined pattern.

The process cartridges 50 are arranged along a front-back direction between the upper cover 12 and the sheet feed unit 20. As shown in FIG. 2, each of the process cartridges 50 has a drum unit 51 and a development cartridge 61 removably attached to the corresponding drum unit 51.

Each of the drum units 51 has a drum frame 52 serving as an example of a process frame; a photosensitive drum 53 that is rotatably supported by the corresponding drum frame 52 and that serves as an example of a photosensitive element; and an electrification unit 54 supported by the corresponding drum frame 52. As a result of the development cartridge 61 being attached to the corresponding drum frame 52, an exposure aperture 55 for exposure purpose that causes the corresponding photosensitive drum 53 to face the outside is created. Specifically, the exposure aperture 55 is formed at a position opposing the photosensitive drum 53 and into a size which allows loose fitting of the LED unit 40. Structures of neighborhoods of the exposure aperture 55 and the electrification unit 54 of the process cartridge 50 will be described in detail later.

Each of the development cartridges 61 has a development frame 62 serving as an example of the process frame; a development roller 63 and a supply roller 64 that are rotatably supported by the development frame 62; a layer thickness regulation blade 65 that makes slidably contact with the corresponding development roller 63; and a toner storage chamber 66 that stores toner T.

As shown in FIG. 1, the transfer unit 70 is interposed between the sheet feed unit 20 and the respective process cartridges 50 and has a drive roller 71, a driven roller 72, a conveyor belt 73, transfer rollers 74, and a cleaning unit 75.

The drive roller 71 and the driven roller 72 are arranged in parallel and spaced apart from each other along the front-back direction, and the conveyor belt 73 consisting of an endless belt is stretched in a tensile fashion between the drive roller and the driven roller. An exterior surface of the conveyor belt 73 remains in contact with the respective photosensitive drums 53. The transfer rollers 74 which hold the conveyor belt 73 such that the belt is sandwiched between the transfer rollers and the respective photosensitive drums 53 are provided in number of four at the inside of the conveyor belt 73 so as to oppose the respective photosensitive drums 53. A transfer bias is applied to the transfer rollers 74 at the time of transfer operation by constant current control.

The cleaning unit 75 is disposed beneath the conveyor belt 73 and configured in such a way as to remove the toner T adhering to the conveyor belt 73, thereby causing the thus-removed toner T to drop into a toner reservoir section 76 located below the cleaning unit 75.

A fixing unit 80 is located at the rear of the respective process cartridges 50 and the transfer unit 70; and has a heating roller 81 and a press roller 82 that is disposed opposite the heating roller 81 and that presses the heating roller 81.

In the thus-configured image forming unit 30, surfaces of the respective photosensitive drums 53 are first uniformly, positively electrified by the electrification units 54 and subsequently irradiated with light from the respective LED units 40, to thus become exposed. Electric potentials of the thus-exposed areas decrease, so that electrostatic latent images are produced from image data on the respective photosensitive drums 53.

The toner T in the toner storage chamber 66 is supplied to the corresponding development roller 63 by rotation of the supply roller 64, and the toner enters a space between the corresponding development roller 63 and the corresponding layer thickness regulation blade 65 by rotation of the development roller 63, to thus be held over the development roller 63 in the form of a thin layer having a given thickness. The toner T held over the development roller 63 is positively electrified through friction between the feed roller 64 and the development roller 63 and between the development roller 63 and the layer thickness regulation blade 65.

The toner T held over the development roller 63 is supplied to the electrostatic latent image formed on the corresponding photosensitive drum 53. Thereby the toner T is selectively held on the photosensitive drum 53, whereby the electrostatic latent image is visualized, and a toner image is produced through reversal development.

The sheet P fed onto the conveyor belt 73 passes between the respective photosensitive drums 53 and the respective transfer rollers 74, whereby the toner images produced on the respective photosensitive drums 53 are transferred onto the sheet P. When the sheet P passes between the heating roller 81 and the press roller 82, the toner images transferred onto the sheet P are thermally fixed.

The sheet output unit 90 has a sheet-output-side conveyance path 91 that is formed so as to upwardly extend from an exit of the fixing unit 81 and to turn toward the front and a plurality of conveyor rollers 92 that convey the sheet P. The sheet P on which the toner image is transferred and thermally fixed is conveyed along the sheet-output-side conveyance path 91 by means of the conveyance rollers 92; is output to the outside of the apparatus main unit 10; and is piled up on the sheet output tray 13.

<Detailed Structure of the Process Cartridge>

Structures of the neighborhoods of the exposure aperture 55 and the electrification unit 54 of the process cartridge 50 will now be described in detail.

As shown in FIG. 2, the electrification unit 54 has an electrification wire 54A for electrifying the photosensitive drum 53 and an electrification frame 54B that supports the electrification wire 54A. The electrification frame 54B has a grid B1 having a plurality of first openings B11 for inducing corona discharge between the apertures and the electrification wire 54A, and a support frame B2 that supports the electrification wire 54A and the grid B1. The support frame B2 is a cylindrical closed-end area that is formed integrally on the drum frame 52. An opening B21 of the support frame is arranged while oriented toward the photosensitive drum 53, and a second opening B23 for letting the electrification wire 54A face the outside is formed in a bottom wall B22 of the support frame. The second opening B23 is created for drawing fresh air into the electrification frame 54B from the outside, thereby maintaining electrification performance of the electrification wire 54A.

Specifically, the electrification frame 54B has the first openings B11 formed between the photosensitive drum 53 and the electrification wire 54A and the second opening B23 formed at a position opposite the first openings B11 with the electrification wire 54A sandwiched therebetween. The first openings B11 and the second opening B23 are openings that are made in the form of an elongated groove and that extend in the right-left direction (the axial direction of the photosensitive drum 53).

The plurality of process cartridges 50 are arranged in such a way that one process cartridge 50 (e.g., 50A) of a pair of adjacent process cartridges 50 opposes the second opening B23 and the exposure aperture 55 of the electrification unit 54 of the other process cartridge 50 (e.g., 50B). A regulation member 100 for regulating airflow is provided between the pair of adjacent process cartridges 50 (e.g., 50A and 50B).

Figure 3:
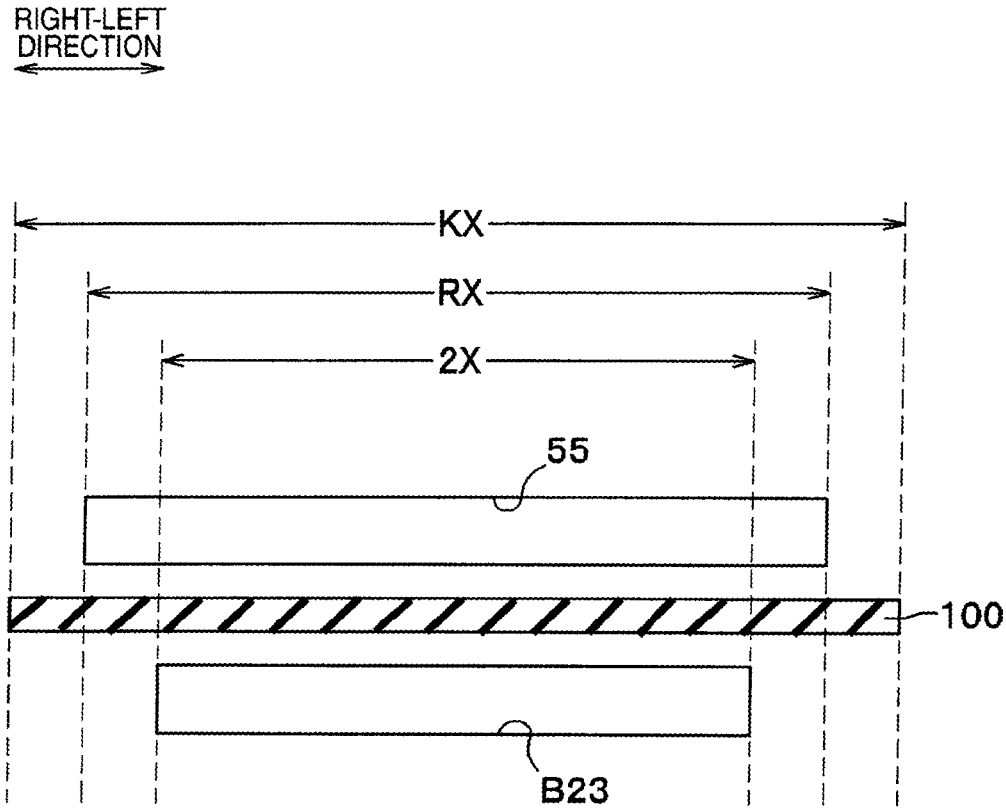
FIG. 3 is a descriptive view that compares a regulation member, an exposure aperture, and a second opening in terms of a length achieved in a right-left direction.

FIG. 3 is an explanatory view for comparing the regulation member 100, the exposure aperture 55, and the second opening B23 with each other in terms of a length achieved in the right-left direction (an axial direction of the photosensitive drum 53).

As shown in FIG. 3, the regulation member 100 is formed into the shape of a rod that uniformly extends in an elongated manner along the right-left direction. The second opening B23 is formed such that its width 2X achieved in the right-left direction becomes smaller than a width KX of the regulation member 100 and falls within the width of the regulation member 100. Further, the exposure aperture 55 is made such that its width RX achieved in the right-left direction becomes smaller than the width KX of the regulation member 100 and falls within the width of the regulation member 100.

The regulation member 100 is a member exhibiting elasticity; for instance, rubber and the like, and interposed between the second opening B23 and the exposure aperture 55 of the electrification unit 54. Specifically, the regulation member 100 is located at a position where airflow from the exposure aperture 55 to the second opening B23 is to be regulated. In the exemplary embodiment, the regulation member 100 is provided on a back side 510 of the process cartridge 50. The back side 510 now refers to a surface of the adjacent process cartridge 50 (e.g., 50B) facing the electrification unit 54, and the regulation member 100 is placed at a position on the back side 510 between the second opening B23 of the electrification unit 54 and the exposure aperture 55.

After being electrified by the electrification unit 54, the photosensitive drum 53 is exposed by the LED unit 40 that loosely fits to the exposure aperture 55, and the toner T is subsequently supplied to the photosensitive drum 53 from the development roller 63. Therefore, the photosensitive drum rotates in a counterclockwise direction of the drawing in such a way that the toner sequentially passes through the electrification unit 54, the exposure aperture 55, and the development roller 63. Therefore, in another way, the arrangement of the regulation member 100 is expressed such that the regulation member 100 is interposed between a pair of adjacent process cartridges 50 (e.g., 50A and 50B) and that the regulation member 100 is placed, in the rotating direction of the photosensitive drum 53 of the forwardly-located process cartridge 50 (e.g., 50B) of the pair of adjacent process cartridges 50, an upstream position with respect to the exposure aperture 55 of the forwardly-positioned process cartridge 50 (e.g., 50B) as well as at a downstream position with respect to the second aperture B23 of the electrification unit 54 of the forwardly-positioned process cartridge 50 (e.g. 50B).

The regulation member 100 thus provided on the back side 510 of the process cartridge 50 (e.g., 50A) projects from the back side 510, to thus close a path 200 defined between the pair of process cartridges 50 with a nominal remaining gap. Specifically, nominal clearance is created between the regulation member 100 provided on the backwardly-positioned process cartridge 50A of the pair of adjacent process cartridges 50A and 50B and a surface 520 of the forwardly-positioned process cartridge 50B. Put another way, the regulation member 100 provided on the backwardly-positioned process cartridge 50A is configured so as not to overlap a removal attachment path 210 of the forwardly-positioned process cartridge 50B. The removal attachment path 210 refers to a locus plotted by an exterior surface of the process cartridge 50 that is removably attached, while being guided, to the apparatus main unit 10.

A deformation regulation portion 512, which projects toward the outside beyond a mount surface 511 where the regulation member 100 is to be attached, is formed on the back side 510 of the process cartridge 50. Therefore, when the process cartridge 50 is removed from the apparatus main unit 10 and positioned on a table (not illustrated) with the back side 510 down, an area 513, which is located at a position on the back side 510 of the process cartridge 50 opposite to the deformation regulation portion 512 with the regulation member 100 sandwiched therebetween, and the deformation regulation portion 512 comes into contact with the table, to thus prevent collapse (deformation) of the regulation member 100, which would otherwise be caused by the weight of the process cartridge 50.

As shown in FIG. 1, the apparatus main body 10 is provided with air outlets 302 letting the air in the apparatus main unit 10 exit to the outside and an exhaust fan 303 as well as with air inlets 301 for drawing external air into the apparatus main unit 10. The air inlets 301 are formed below the plurality of process cartridges 50, and the air outlets 302 are formed at the rear of the plurality of process cartridges 50. As a result of the air inlets 301 and the air outlets 302 being arranged as mentioned above, the air drawn in the apparatus main unit 10 from the air inlets 301 enters the process cartridges 50 from the second openings B23 of the electrification units 54 of the respective process cartridges 50; pass through the exposure apertures 55 from the inside of the respective process cartridges 50, to thus exit from positions above the paths 200 and travel toward the air outlets 302. Each of the air outlets 302 is provided with a filter (not illustrated), and the filters securely capture extraneous matters, such as toner, paper dust, and ozone, included in the air passing through the air outlets 302.

Positions of the air inlets 301 and the air outlets 302, where airflow, such as that mentioned above, is achieved, can be arbitrarily determined by previously performing a test, simulation, and the like.

Flow of ionic wind achieved when the photosensitive drums 53 are electrified by the electrification units 54 will now be described. Of the drawings to which reference is to be made, FIG. 4 is an enlarged cross-sectional view showing the flow of ionic wind.

Figure 4:
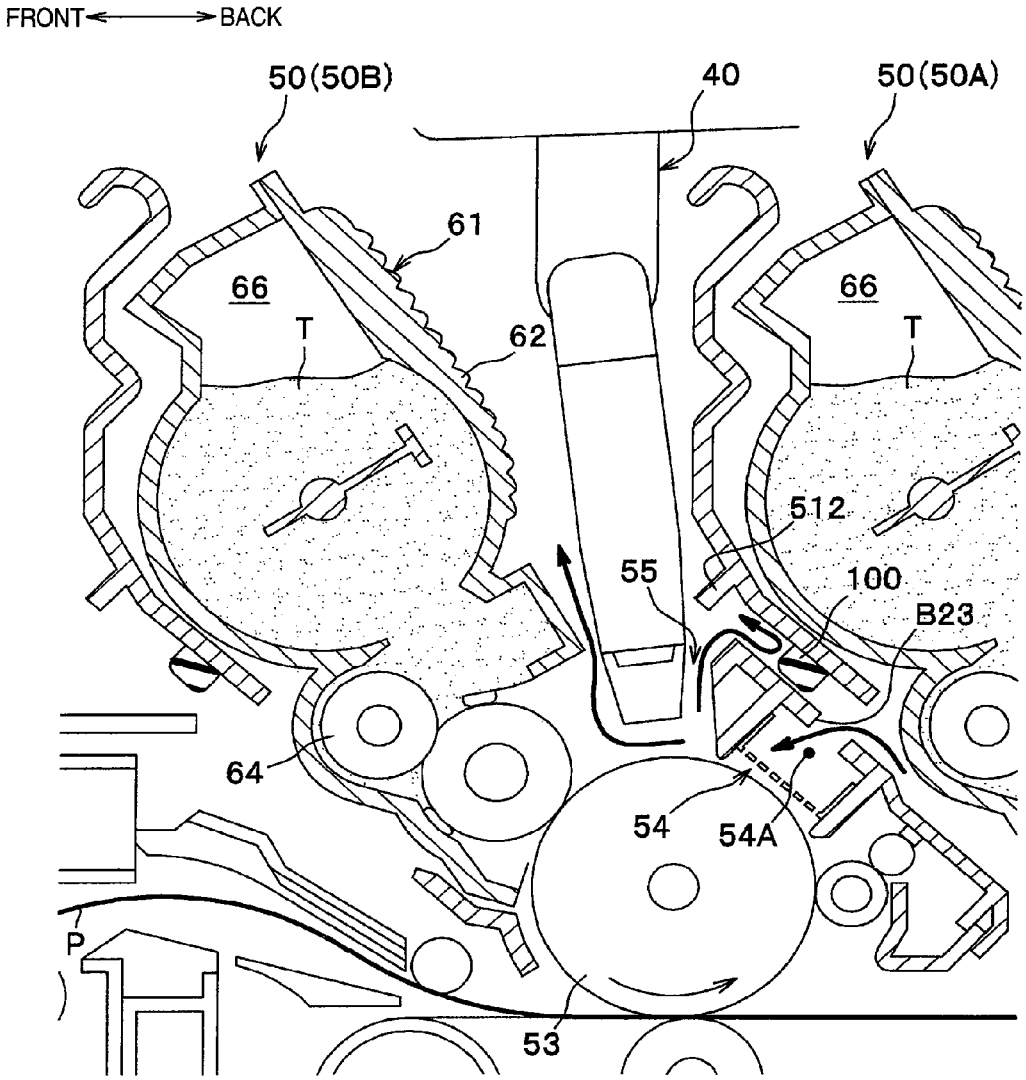
FIG. 4 is an enlarged cross-sectional view showing flow of ionic wind.

As shown in FIG. 4, when the photosensitive drum 53 is electrified by the electrification unit 54, ionic wind developed in electrification wire 54A is blown to the photosensitive drum 53 and subsequently sent toward the front by rotation of the photosensitive drum 53. The wind then exits to the outside of the process cartridge 50B after passing through the exposure aperture 55. At this time, even when the ionic wind attempts to migrate toward the electrification unit 54 after colliding with the adjacent process cartridge 50A, migration of the wind is regulated by the regulation member 100. Hence, reentry of the ionic wind exited from the exposure aperture 55 into the second opening B23 of the electrification unit 54 is prevented. After exited from the exposure aperture 55 to the outside of the process cartridge 50B, the ionic wind is sucked upwardly by suction force of the exhaust fan 303 (the direction of an air flow caused by operation of the exhaust fan 303). Hence, a flow, such as that originating from the exposure aperture 55 toward the second opening B23, becomes difficult to arise.

According to the foregoing descriptions, the exemplary embodiment can yield advantages, such as those provided below.

The regulation member 100 can inhibit reentry of the ionic wind exited from the exposure aperture 55 into the second opening B23 of the electrification unit 54. Accordingly, reentry of the ionic wind into the process cartridge 50B is regulated, and fresh air that does not contain much extraneous matters or ozone is drawn by way of the second opening B23. Thus, it is possible to prevent adhesion of extraneous matters, such as paper dust or a developing agent, included in the ionic wind to the electrification wire 54A and the photosensitive drum 53 or deterioration of the photosensitive drum 53, which would otherwise be caused by ozone included in the ionic wind. Therefore, image quality can be enhanced.

Since the regulation member 100 is elastically deformable, infliction of damage to the regulation member 100 and the process cartridge 50 can be prevented even when the regulation member is formed, for reasons of manufacturing errors, to a height at which the regulation member interferers with the adjacent process cartridge 50. Further, even when the regulation member 100 interferes with the process cartridge 50 at the time of attachment of the process cartridge 50, displacement of the process cartridge 50 with respect to the apparatus main unit 10, which would otherwise be caused by deformation of the regulation member 100, can be prevented.

The second opening B23 is formed in such a way that its width 2X achieved in the right-left direction becomes narrower than the width KX of the regulation member 100 and falls within the width of the regulation member 100. Therefore, the regulation member 100 can reliably prevent the ionic wind flowed from the exposure aperture 55 to the outside of the process cartridge 50 from traveling toward the second opening B23.

Moreover, the exposure aperture 55 is formed such that its width RX achieved in the right-left direction becomes narrower than the width KX of the regulation member 100 and falls within the width of the regulation member 100. Therefore, the regulation member 100 can reliably prevent the ionic wind flowed from the exposure aperture 55 to the outside of the process cartridge 50 from traveling toward the second opening B23.

The regulation member 100 is configured so as not to overlap a path of removal attachment of an adjacent process cartridge 50. Therefore, infliction of damage to the regulation member 100, which would otherwise be caused as a result of the process cartridge 50 interfering with the regulation member 100 at the time of removal attachment of the process cartridge 50, can be prevented.

The deformation regulation portion 512 can regulate collapse of the regulation member 100, which would otherwise be caused when the process cartridge 50 is placed with its back side 510 down. Hence, there can be prevented an increase in clearance, which would otherwise be created between the regulation member 100 and the front side 520 of the process cartridge 50 by permanent deformation of the regulation member 100 at the time of storage of the process cartridge 50.

The ionic wind exited from the exposure aperture 55 to the outside of the process cartridge 50 is upwardly sucked by the flow of air traveling in sequence of the air inlet 301, the second opening B23, the exposure aperture 55, and the air outlet 302, thereby posing difficulty on travel of the ionic wind from the exposure aperture 55 toward the second opening B23. Hence, entry of the ionic wind from the exposure aperture 55 to the second opening B23 can be inhibited further.

The present invention is not limited to the above described exemplary embodiment and can be utilized in various forms as illustrated below.

Figure 5:
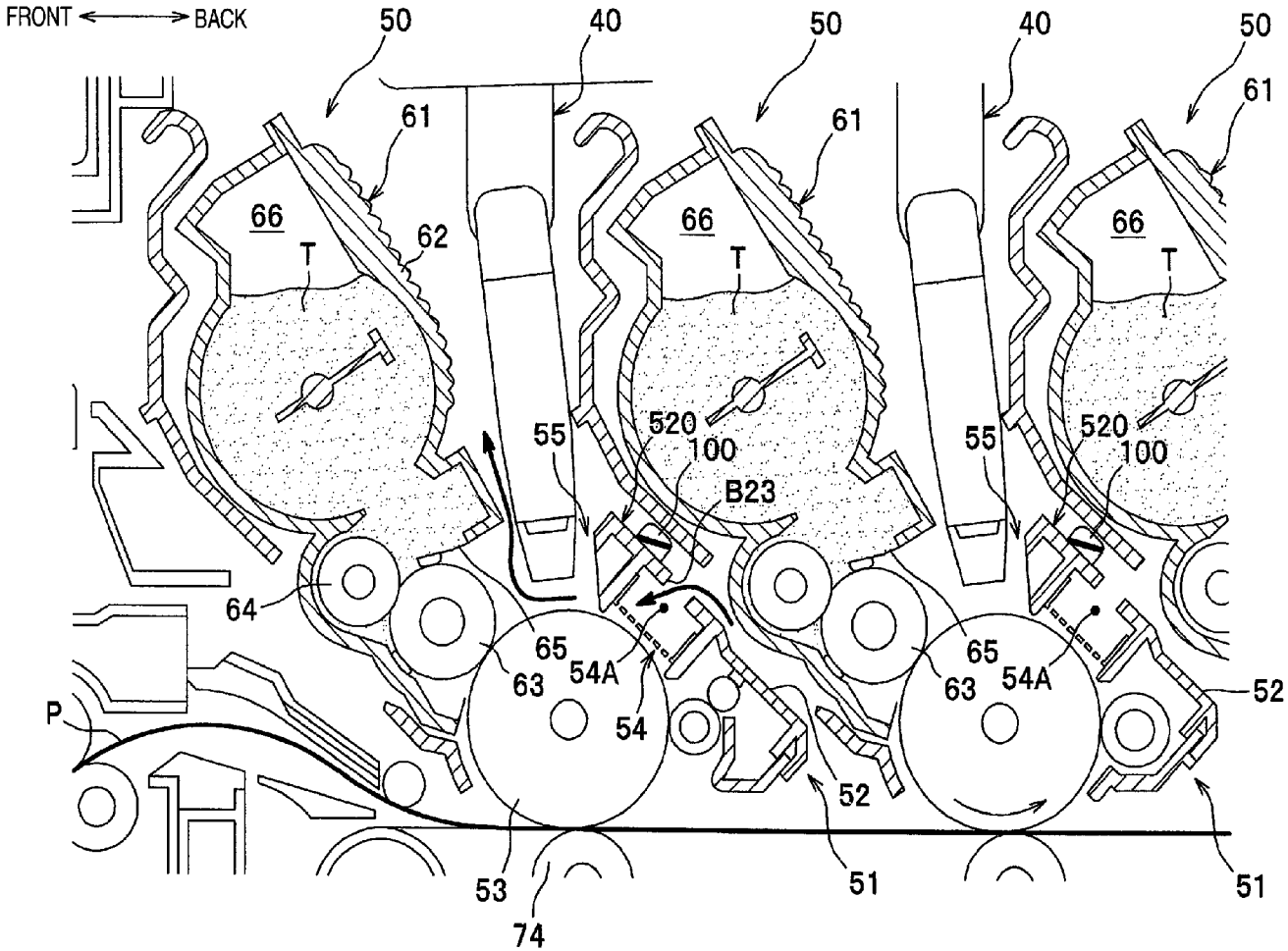
FIG. 5 is a cross-sectional view showing a mode in which a regulation member is provided on a surface of the process cartridge.

In the exemplary embodiment, the regulation member 100 is provided on the back side 510 of the process cartridge 50. However, the exemplary embodiment is not limited to the embodiment. So long as the regulation member is interposed between the second opening B23 of the electrification unit 54 and the exposure aperture 55, the regulation member 100 may also be provided on the front side 520 of the process cartridge 50 as shown in FIG. 5.

Figure 6:
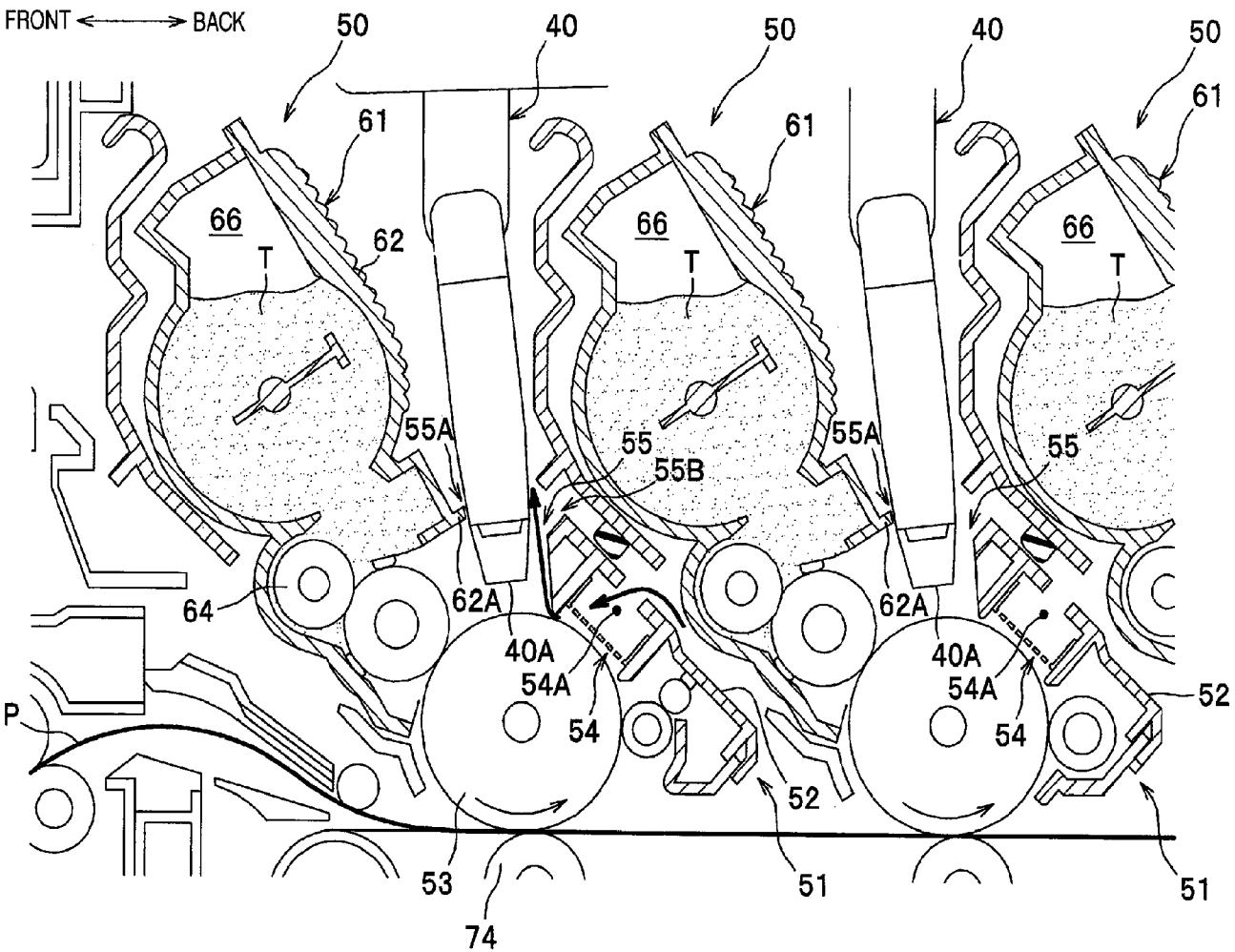
FIG. 6 is a cross-sectional view showing a mode in which a shield wall is provided on a frame of the process cartridge.

In the exemplary embodiment, clearance between an inner peripheral surface of the exposure aperture 55 and an outer peripheral surface of the LED unit 40 is created to a comparatively-large size. However, the present invention is not limited to the embodiment. For instance, as shown in FIG. 6, a shield wall 62A that closes, of the clearance existing between the exposure aperture 55 and the LED unit 40, clearance 55A opposite to the electrification unit 54 with a nominal remaining gap may also be formed in the development frame 62 of the process cartridge 50. According to the configuration, as a result of the clearance 55A of the shield wall 62A being closed, the ionic wind developed in the electrification unit 54 upwardly flows in a precisely-exact fashion without passing below a lens surface 40A of the LED unit 40, so that adhesion of stains to the lens surface 40A can be prevented.

Incidentally, there is a configuration in which the clearance 55A is closed by the shield wall 62A, the ionic wind developed in the electrification unit 54 comes to intensively pass through the clearance 55B of the electrification unit 54. Thus, if the ionic wind developed in the electrification unit 54 comes to intensively pass through the clearance 55B of the electrification unit 54, the ionic wind will become likely to reenter the second opening B23 of the electrification unit 54 in the related-art configuration. However, in the exemplary embodiment, the regulation member 100 is provided, and hence reentry of the ionic wind to the second opening B23 of the electrification unit 54 is prevented. The essential requirement for the shield wall 62A is to be positioned so as to close the clearance 55A, and hence the shield wall may also be provided on the LED unit 40.

Figure 7:
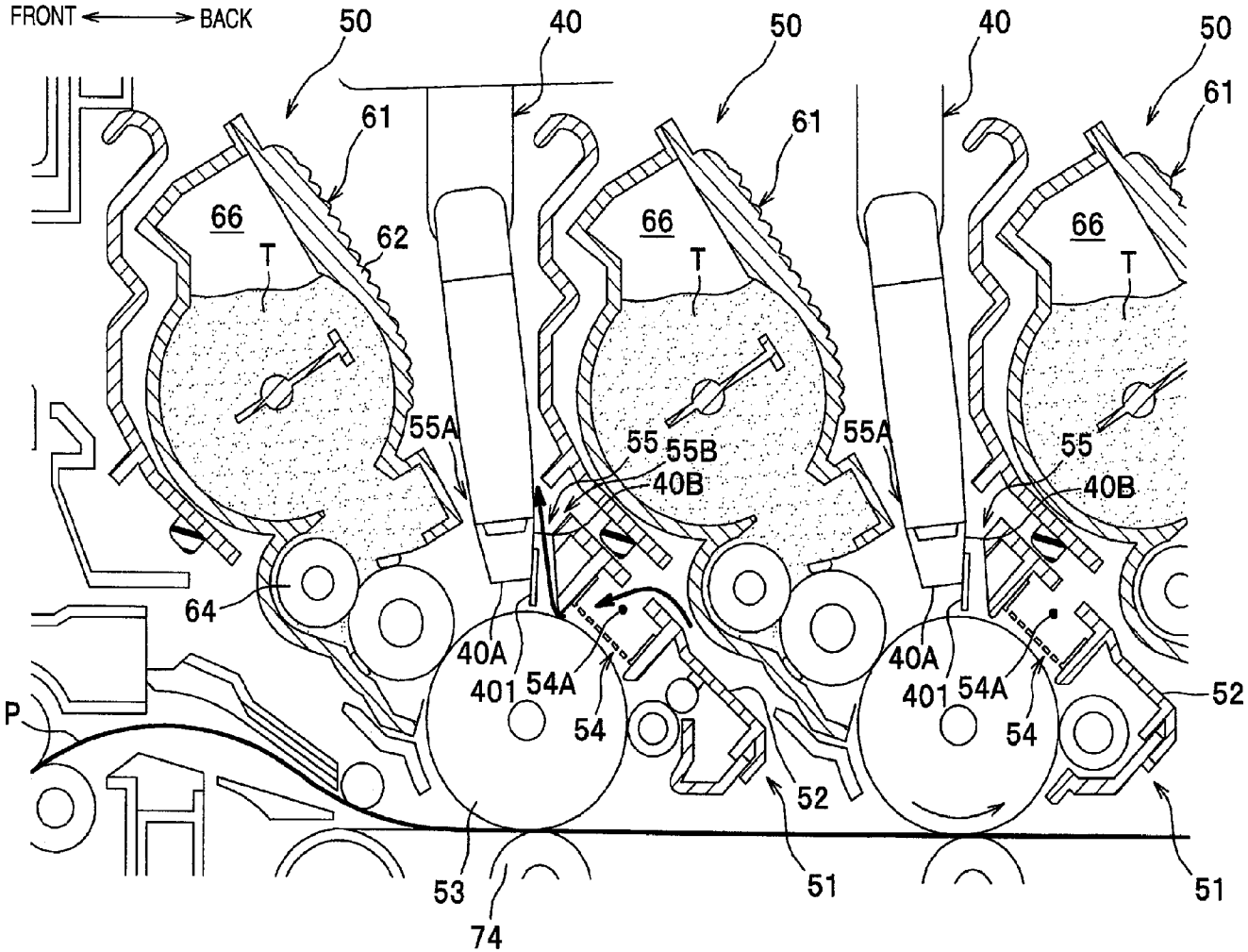
FIG. 7 is a cross-sectional view showing a mode in which a block wall is provided on a surface of an LED unit facing an electrification unit.

As shown in FIG. 7, a block wall 401 that projects toward the photosensitive drum 53 than toward the lens surface 40A, to thus close clearance between the lens surface 40A and the photosensitive drum 53 with a nominal remaining gap may also be provided on a face 40B opposing the electrification unit 54 of the LED unit 40 in place of the shield wall 62A. According to the configuration, clearance between the lens surface 40A and the photosensitive drum 53 is closed by the block wall 401, and hence the ionic wind developed in the electrification unit 54 upwardly flows in a precisely-exact fashion without passing below the lens surface 40A of the LED unit 40, thereby inhibiting adhesion of stains to the lens surface 40A.

Incidentally, when there is a configuration in which the block wall 401 is provided as mentioned above, the ionic wind developed in the electrification unit 54 intensively passes through the clearance 55B of the electrification unit 54 of the clearance existing between the exposure aperture 55 and the LED unit 40. Thus, if the ionic wind developed in the electrification unit 54 comes to intensively pass through the clearance 55B of the electrification unit 54, the ionic wind will become likely to reenter the second opening B23 of the electrification unit 54 in the case of the related-art configuration. However, in the present embodiment, the regulation member 100 is provided, and hence reentry of the ionic wind to the second opening B23 of the electrification unit 54 is prevented.

Both the block wall 401 and the foregoing shield wall 62A (see FIG. 6) may also be provided. In this case, it becomes more difficult for the ionic wind developed in the electrification unit 54 to pass below the lens surface 40A of the LED unit 40 by virtue of a synergistic effect of the block wall 401 and the shield wall 62A. Hence, adhesion of stains to the lens surface 40A can be prevented in a more reliable manner.

In the exemplary embodiment, the regulation member 100 is formed into an essentially-parallelepiped rectangular shape. However, the present invention is not limited to the shape. The essential requirement for the regulation member is to be configured in such a way that the regulation member becomes easier to deform than do the drum frame and the development frame. Specifically, the essential requirement for the regulation member is to be formed from a material exhibiting smaller elasticity than elasticity of a material of the drum frame and the development frame. For instance, the regulation member may also be formed into the shape of a thin plate, such as a film.

In the exemplary embodiment, a plurality of LEDs arranged in a line along the right-left direction are provided as the exposure member of the LED unit 40. However, the present invention is not limited to the exposure member. For instance, an LED unit having a plurality of LED rows arranged in the front-back direction, each of which includes a plurality of LEDs arranged in a line along the right-left direction, may also be adopted as the exposure member. Further, the exposure member may also be built from one light-emitting element, such as an LED and a fluorescent lamp, and a plurality of optical shutters that are made of liquid crystal or a PLZT element and that are arranged outside the light-emitting element and in the right-left direction. The light source of the exposure member is not limited to an LED and may also be an EL (electroluminescent) element or a fluorescent substance.

In the exemplary embodiment, the LED unit 40 is fitted into the exposure aperture 55. However, the present invention is not limited to the configuration. For instance, a scanner unit that irradiates the photosensitive drum with a laser beam may also be provided in lieu of the LED unit 40, and the laser beam emitted from the scanner unit may also be caused to pass through the exposure aperture.

In the exemplary embodiment, there is adopted a configuration in which ventilation of the apparatus main unit 10 is performed by providing the air outlet 302 with the exhaust fan 303. However, the present invention is not limited to the configuration. Ventilation may also be performed by providing the air inlet with an inlet fan.

In the exemplary embodiment, a cartridge integrally including the toner storage chamber 66 for storing toner is adopted as the process cartridge. However, the present invention is not limited to the configuration. For instance, a development cartridge configured as a component separate from a toner cartridge having the toner storage chamber may also be taken as a process cartridge.

In the exemplary embodiment, the present invention is applied to the color printer 1. However, the present invention is not limited to the configuration. The present invention may also be applied to another image forming apparatus; for instance, a copier and a multifunction machine.

What is claimed is:

1. An image forming apparatus comprising:

a body; and a plurality of process cartridges, each process cartridge comprising:

a photosensitive element that is configured to hold an electrostatic latent image thereon;

an electrification unit that includes a discharging unit which extends along a surface of the photosensitive element and which is configured to electrify the photosensitive element by discharging;

an electrification frame which accommodates the discharging unit and which has a first opening formed between the photosensitive element and the discharging unit and a second opening formed at a position opposite the first opening across the discharging unit; and a process frame that supports the photosensitive element and the electrification unit, the process frame including an exposure opening opposing the photosensitive element for exposing the photosensitive element, wherein the plurality of process cartridges are arranged such that one process cartridge of a pair of adjacent process cartridges opposes the second opening of the electrification unit and the exposure opening of the other process cartridge;

a regulation member that is configured to regulate airflow is provided between the pair of process cartridges; and the regulation member has elasticity and is provided on a surface of the one process cartridge opposing the other process cartridge in a position between the second opening of the electrification unit and the exposure opening when the process cartridge is attached to the body.

2. The image forming apparatus according to claim 1, wherein the regulation member is attached to a surface of the one process cartridge opposing the other process cartridge and configured so as not to overlap a removal attachment path of the other process cartridge.

3. The image forming apparatus according to claim 2, wherein the process frame of the one process cartridge further comprises a deformation regulation portion which projects to the outside over a surface where the regulation member is to be attached and which regulates deformation of the regulation member.

4. The image forming apparatus according to claim 1, further comprising:

an exposure member that is loosely fit into the exposure opening and that exposes the photosensitive element, wherein a block wall projecting toward the photosensitive element is provided on a surface of the exposure member facing the electrification unit.

5. The image forming apparatus according to claim 1, further comprising:

an exposure member that is loosely fit into the exposure opening and that exposes the photosensitive element, wherein the exposure member or the process frame comprises a shield wall for closing, of clearance existing between the exposure opening and the exposure member, a gap opposite to the electrification unit.

6. The image forming apparatus according to claim 1, further comprising:

an air inlet that is configured to draw external air into an apparatus main unit; and an air outlet that is configured to allow air in the apparatus main unit exit to an outside, wherein the air inlet and the air outlet are arranged such that the air drawn into the apparatus main unit from the air inlet enters each of the process cartridges from the second opening of the electrification unit of the process cartridge and travels from inside of the process cartridge toward the air outlet after passing through the exposure opening.

7. A process cartridge comprising:

a photosensitive element that holds an electrostatic latent image thereon;

an electrification unit that includes a discharging unit which extends along a surface of the photosensitive element and which is configured to electrify the photosensitive element by discharging;

an electrification frame that contains the discharging unit and that has a first opening formed between the photosensitive element and the discharging unit and a second opening formed at a position opposite the first opening across the discharging unit; and a process frame that supports the photosensitive element and the electrification unit, the process frame including an exposure opening opposing the photosensitive element for exposing the photosensitive element, wherein the process cartridge is configured to oppose the second opening of the electrification unit and an exposure opening of another process cartridge, and wherein a surface of the process cartridge is configured to accommodate an elastically-deformable regulation member, the surface configured to oppose the other process cartridge in a position between the second opening of the electrification unit and the exposure opening of the other process cartridge when the process cartridge is attached to an image forming apparatus.

* * * * *